US009714803B2

(12) United States Patent
Giebel et al.

(10) Patent No.: US 9,714,803 B2
(45) Date of Patent: Jul. 25, 2017

(54) DESTRUCTION UNIT AND FIREARM WITH SAID DESTRUCTION UNIT AND METHOD FOR RENDERING A FIREARM INOPERATIVE

(71) Applicant: Karl-Friedrich Giebel, Brannenburg (DE)

(72) Inventors: Karl-Friedrich Giebel, Brannenburg (DE); Ernst Mauch, Dunningen (DE); Bernd Dietel, Lachen (CH)

(73) Assignee: Karl-Friedrich Giebel, Brannenburg (DE)

( * ) Notice: Subject to any disclaimer, the term of this patent is extended or adjusted under 35 U.S.C. 154(b) by 0 days.

(21) Appl. No.: 14/440,914

(22) PCT Filed: Nov. 6, 2013

(86) PCT No.: PCT/EP2013/003331
§ 371 (c)(1),
(2) Date: Nov. 2, 2015

(87) PCT Pub. No.: WO2014/072045
PCT Pub. Date: May 15, 2014

(65) Prior Publication Data

US 2016/0047616 A1 Feb. 18, 2016

(30) Foreign Application Priority Data

Nov. 6, 2012 (DE) ..... 10 2012 021 754

(51) Int. Cl.
*F41A 17/00* (2006.01)
*F41A 17/42* (2006.01)
(Continued)

(52) U.S. Cl.
CPC ..... *F41A 17/64* (2013.01); *F41A 17/00* (2013.01); *F41A 17/74* (2013.01); *F41A 17/42* (2013.01)

(58) Field of Classification Search
CPC ..... F41A 17/00; F41A 17/08; F41A 17/42; F41A 17/44
(Continued)

(56) References Cited

U.S. PATENT DOCUMENTS 4,090,316 A * 5/1978 Volkmar ..... F41A 17/72 42/70.08
4,682,435 A * 7/1987 Heltzel ..... F41A 17/063 42/70.01
(Continued)

FOREIGN PATENT DOCUMENTS

DE 19523399 1/1997
DE 102010008862 5/2011
(Continued)

OTHER PUBLICATIONS

International Search Report for related International Application No. PCT/EP2013/003331; report dated Jan. 24, 2014.

*Primary Examiner* — Derrick Morgan
(74) *Attorney, Agent, or Firm* — Miller, Matthias & Hull LLP

(57) ABSTRACT

The present invention relates to devices and methods for introducing, in a firearm comprising a movement space arranged in a housing of the firearm and provided for a moveable component of the firearm or for a fluid moveable within the firearm, a filling material, which, at least in part, fills the movement space and preferably solidifies therein, into the movement space, when there is a condition in which the firearm is to be disabled.

36 Claims, 9 Drawing Sheets

(51) Int. Cl.
*F41A 17/64* (2006.01)
*F41A 17/74* (2006.01)

(58) Field of Classification Search
USPC ..... 42/70.11
See application file for complete search history.

(56) References Cited

U.S. PATENT DOCUMENTS 5,062,232 A * 11/1991 Eppler ..... F41A 17/063 42/70.11
5,231,236 A * 7/1993 Del Real ..... F41A 17/44 42/70.11
5,394,635 A * 3/1995 Stuart ..... F41A 17/44 102/447
5,450,685 A * 9/1995 Peterson ..... F41A 17/44 42/70.11
5,675,925 A * 10/1997 Wurger ..... F41A 17/06 42/70.06
6,148,557 A * 11/2000 Lindskog ..... F41A 17/44 42/70.01
6,226,914 B1 * 5/2001 Reed ..... F41A 17/44 42/70.08
6,308,450 B1 * 10/2001 Ireblad ..... F41A 17/44 42/70.02
6,415,542 B1 * 7/2002 Bates ..... F41A 17/06 42/70.05
6,494,069 B1 * 12/2002 Ireblad ..... E05B 17/2092 42/70.11
6,563,940 B2 * 5/2003 Recce ..... B60R 25/04 382/120
6,615,528 B1 * 9/2003 Lindskog ..... F41A 17/00 42/70.01
6,843,014 B1 * 1/2005 Aponte ..... F41A 17/06 42/70.06
7,339,456 B1 * 3/2008 Buckley ..... F41A 17/063 340/5.51
8,087,551 B2 * 1/2012 Henley, II ..... F41A 13/04 206/219
8,205,372 B2 * 6/2012 Anzeloni ..... F41A 17/063 42/70.01
8,640,620 B1 * 2/2014 Hoang ..... F42C 15/184 102/229
8,887,638 B1 * 11/2014 Calvert ..... F42B 12/20 102/430
2002/0059746 A1 * 5/2002 Ross ..... F41A 17/44 42/70.11
2010/0005992 A1 * 1/2010 Crawford ..... E21B 43/119 102/202.1
2014/0202058 A1 * 7/2014 Zhou ..... F41A 17/063 42/70.11
2014/0305018 A1 * 10/2014 Horanoff ..... F41A 17/04 42/70.11
2015/0241153 A1 * 8/2015 Mardirossian ..... F41A 17/08 42/70.11
2016/0025438 A1 * 1/2016 Alderman ..... G01S 19/14 42/70.11
2016/0202025 A1 * 7/2016 Di Mauro Lorenzi . F41H 13/00 89/1.11

FOREIGN PATENT DOCUMENTS

DE 102012014400 7/2013
WO 2011070064 6/2011

* cited by examiner

Fig. 11a (before)
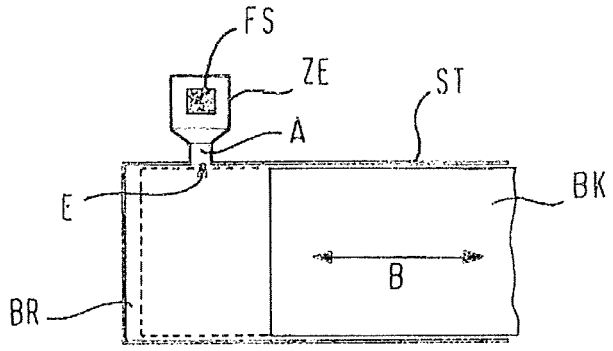
Fig. 11b (after)
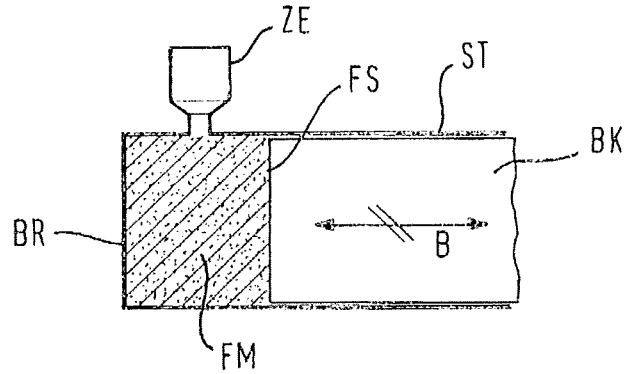
Fig. 12a (before)
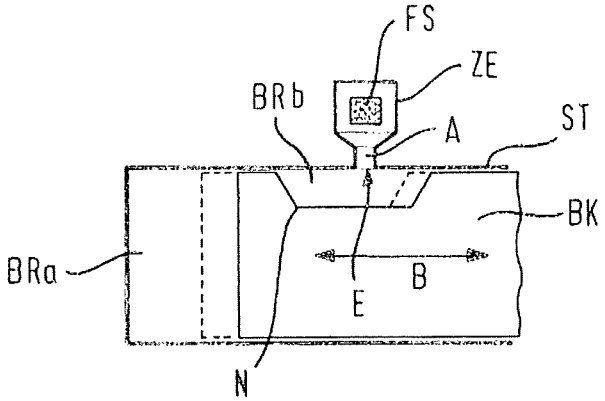
Fig. 12b (after)
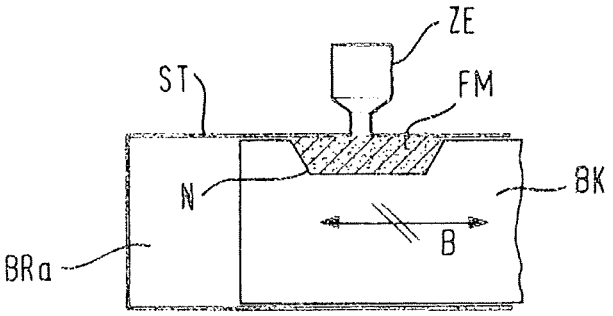

DESTRUCTION UNIT AND FIREARM WITH SAID DESTRUCTION UNIT AND METHOD FOR RENDERING A FIREARM INOPERATIVE

CROSS-REFERENCE TO RELATED APPLICATIONS

This application is a U.S. national stage filing of International Patent Application No. PCT/EP2013/003331 filed on Nov. 6, 2013, which claims priority under the Paris Convention to German Patent Application No. 10 2012 012 754.4, filed on Nov. 6, 2012.

FIELD OF THE DISCLOSURE

The present invention relates, in general, to firearms and, in particular, to devices and methods for rendering one or more components of a firearm, at least in part, permanently inoperable in the case of an unwarranted, unauthorized use thereof.

BACKGROUND OF THE DISCLOSURE

Various approaches are known for preventing abusive use of firearms, such as e.g. pistols, revolvers and rifles. For example, access to a firearm can be prevented by enabling physical access to the firearm for authorized persons only (e.g. storing the firearm in a firearm locker). Furthermore, it is known to activate and/or deactivate electrical and/or electronic components of firearms depending on whether the firearm is operated by an authorized person (e.g. by means of a transmitter of the authorized person transmitting an enabling or disabling signal to a receiver in the firearm).

These approaches are, inter alia, error-prone insofar as the firearm itself remains operable and the firearm can be used when the safeguarding measures are overcome. What is more, in the case of firearms, it is not possible to disable a firearm on a software basis, comparable to an anti-theft device of a motor vehicle.

There are approaches for actually disabling a firearm, wherein the firearm is, at least in part, destroyed by means of an explosive disposed within the firearm. These approaches are, inter alia, error-prone for the following reasons. In some approaches, the explosives are contained in devices provided separately from the firearm which are to be inserted e.g. into the barrel or magazine well of the firearm and are consequently effective only then. In addition, bystanders may be injured by the explosives. Furthermore, in these approaches, mechanical components of the firearm are destroyed which can be replaced also by unauthorized persons, such as e.g. the barrel.

SUMMARY OF THE DISCLOSURE

It is the object of the present invention to provide measures and means which—as compared to the known approaches—in the case of an unauthorized use, disable a firearm substantially permanently, however, at least to such an extent that the firearm can be re-enabled by authorized persons only.

SUMMARY OF THE INVENTION

In order to achieve this object, the present invention provides a firearm comprising a destruction unit, a destruction unit for a firearm, and a method of disabling a firearm according to the independent claims.

Preferred embodiments are stated in the dependent claims and the following description.

In general, the present invention relates to devices and methods for introducing, in a firearm comprising a movement space arranged in a housing of the firearm and provided for a moveable component of the firearm or for a fluid moveable within the firearm, a filling material, which, at least in part, fills the movement space and preferably solidifies therein, into the movement space, when there is a condition in which the firearm is to be disabled.

Firearms covered by the present invention are, in particular, handguns, such as pistols, revolvers and rifles, or long guns irrespective of their type of ammunition to be used.

In particular, the present invention provides a firearm, comprising:

- a housing,
- a movement space, arranged in the housing, for a moveable component of the firearm or for a fluid moveable within the firearm, and
- a destruction unit arranged in the housing and associated with the movement space, wherein
- a material passage extends between the movement space and the destruction unit, and
- the destruction unit can be activated for introducing a filling material into the movement space via the material passage and thus filling, at least in part, the movement space.

The destruction unit preferably comprises a filling composition including one or more substances which, upon activation of the destruction unit, is/are converted into filling material or generate(s) filling material.

The destruction unit can further comprise a heating composition including one or more substances which, upon activation of the destruction unit, generate(s) thermal energy which is supplied to the filling composition for activation thereof. The heating composition can also generate pressure for discharging, at least in part, the filling composition and filling material, respectively, from the destruction unit.

Furthermore, an ignition composition can be provided which generates thermal energy which is supplied to the propellant composition for activation thereof. The ignition composition can also generate pressure for discharging, at least in part, the heating composition and/or the filling composition and filling material, respectively, from the destruction element.

The filling composition preferably comprises a substance which, in response to activation of the destruction unit, expands, at least in part, in the associated movement space.

The filling composition preferably comprises a material which, in response to activation of the destruction unit, reacts exothermically and/or solidifies, at least in part, in the associated movement space.

The movement space preferably comprises a fluid passage being in fluid communication with a barrel of the firearm, wherein the material passage extends between the fluid passage and the destruction unit.

The movement space preferably comprises:

- an area extending substantially in a direction parallel to a direction of movement of the moveable component, and/or
- an area extending substantially in a direction perpendicular to the direction of movement of the moveable component.

In the case of a component of the movement space extending substantially parallel (perpendicular) to the direction of movement, a frictional locking (positive locking) with the moveable component can be achieved by means of a filling material, which inhibits or prevents movements of the moveable component.

The moveable component of the firearm preferably comprises:

a firing pin of the firearm, and/or a hammer of the firearm, and/or a lock of the firearm.

The movement space preferably extends, at least in part, into the moveable component.

The destruction unit preferably comprises a moveable latching means which, in response to activation of the destruction unit, can be introduced, at least in part, into the movement space via the material passage.

The firearm preferably comprises an electrical and/or electronic component and a destruction charge associated therewith.

The filling composition preferably comprises an aluminum-metal foam alloy, and/or intermetallic reactive mixture on Ti basis.

The ignition composition of the destruction unit preferably is an electrically or electronically activatable ignition composition.

The ignition composition preferably comprises a wire igniter which can preferably be arranged on a pressure and/or heat resistant base which can comprise, for example, glass and/or metal.

The ignition composition preferably comprises a CuO/Zr mixture.

The heating composition can comprise, for example, a $TiMoO_3$ mixture.

The heating composition can be arranged in the destruction unit in such a manner that it surrounds, at least in part, the filling composition.

The destruction unit can comprise a cover which can comprise an outlet opening preferably in the area of the filling composition arranged within the destruction unit.

The destruction unit preferably comprises an insert, in which the filling composition is arranged.

The insert can comprise a mouth area which is preferably formed as a nozzle.

A firearm destruction unit comprising:

a housing having an outlet opening, a filling composition which, upon activation thereof, is converted into filling material, and an ignition composition which, upon activation thereof, generates pressure for introducing, at least in part, filling material into a movement space of the firearm via the outlet opening.

The firearm destruction unit can comprise a heating composition which, upon activation thereof, generates thermal energy for converting the filling composition into filling material.

The ignition composition can be implemented such that it also generates pressure for discharging, at least in part, also the heating composition from the housing.

The heating composition can additionally generate pressure for introducing the filling material into the movement space.

The filling composition preferably comprises a material which, in response to activation of the destruction unit, expands, at least in part, in the movement space.

The filling composition preferably comprises a material which, in response to activation of the destruction unit, reacts exothermically and generates an at least partially solid substance as a reaction product.

The destruction unit preferably comprises a moveable latching means which, in response to activation of the destruction unit, can be introduced, at least in part, into the movement space via the outlet opening.

The filling composition can comprise:

an aluminum-metal foam alloy, and/or an intermetallic reactive mixture on Ti basis.

The ignition composition of the destruction unit preferably is an electrically or electronically activatable ignition composition.

The ignition composition preferably comprises a wire igniter which can preferably be arranged on a pressure and/or heat resistant base which can comprise, for example, glass and/or metal.

The ignition composition preferably comprises a CuO/Zr mixture.

The heating composition can comprise, for example, a $TiMoO_3$ mixture.

The heating composition is preferably arranged in the destruction unit in such a manner that the heating composition surrounds, at least in part, the filling composition.

The destruction unit can comprise a cover which can provide the outlet opening in the area of the filling composition arranged within the destruction unit.

The destruction unit can further comprise an insert, in which the filling composition is arranged.

The insert can comprise a mouth area which comprises the outlet opening for the filling composition and/or the filling material and is preferably formed as a nozzle.

Furthermore, the present invention provides a firearm comprising the above destruction unit. The destruction unit is preferably integrally integrated in the firearm, i.e. implemented as an integral component of the weapon, such as e.g. its lock, hammer or firing pin, and not as a separate device which can be connected to or inserted into the firearm.

The present invention further provides a method of disabling a firearm comprising a movement space which is arranged in a housing of the firearm and is provided for a moveable component of the firearm or for a fluid moveable within the firearm, wherein the method comprises:

detecting a condition in which the firearm is to be disabled, and, when such a condition is detected, filling, at least in part, the movement space with a filling material.

The filling material preferably solidifies, at least in part, in the movement space.

The filling material is preferably generated exothermically.

Furthermore, the method can comprise filling, at least in part, a movement space for a firing pin, a hammer, and/or a lock of a firearm with a filling material.

It is further possible that the movement space is/comprises a gas bore being in fluid communication with a barrel of a firearm, and that this gas bore is, at least in part, filled with a filling material.

The method can comprise introducing a mechanical latching means into the movement space and securing the mechanical latching means in the movement space by means of the filling material.

The method can further comprise destroying an electrical and/or electronic component of the firearm in the case of a condition in which the firearm is to be disabled.

BRIEF DESCRIPTION OF THE DRAWINGS

In the following description, reference is made to the attached drawings, in which:

FIGS. 11*a* and 11*b* show schematic representations of an embodiment of the present invention;

FIGS. 12*a* and 12*b* show schematic representations of an embodiment of the present invention;

DETAILED DESCRIPTION

In the following, exemplary embodiments of the present invention are described on the basis of the drawings.

The following explanations, even if made with reference to a drawing, basically apply to all illustrated and described variants of the present invention, unless the contrary is explicitly stated.

Figure 1:
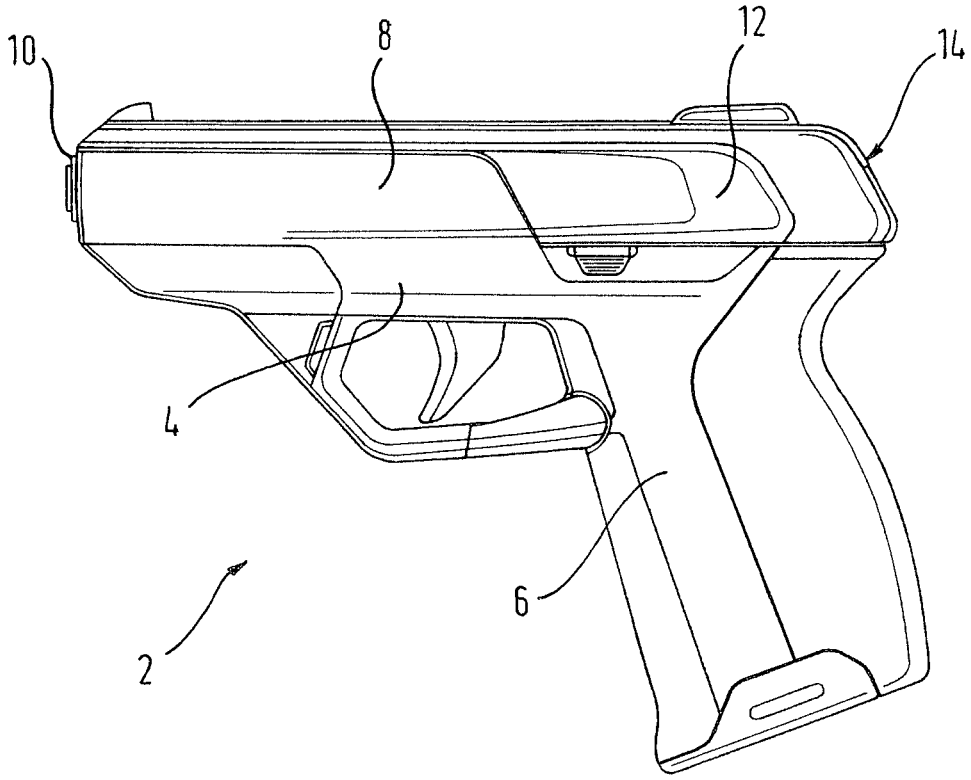
FIG. 1 shows a schematic representation of a firearm.

FIG. 1 schematically shows a firearm in the form of an exemplary pistol 2 without intending to limit the present invention to firearms of this kind.

The firearm 2 comprises a housing which, as a whole, is designated by 4 and which can comprise a plurality of parts, such as e.g. a handle piece 6, in which, in general, a (not designated) magazine and, in the case of more recent types of firearms, also electronic and/or electrical components can be accommodated. The latter can also or additionally be arranged in other areas of the firearm 2, such as e.g. in the area 12 of the lock and the like. The housing 4 of the shown firearm 2 also comprises a part 8, in which a barrel 10 is arranged, and the part 12 which comprises the lock (not designated here). The firearm 2 also comprises a hammer 14. Furthermore, a controller, which is shown in FIG. 2, is arranged in the housing 4.

Figure 2:
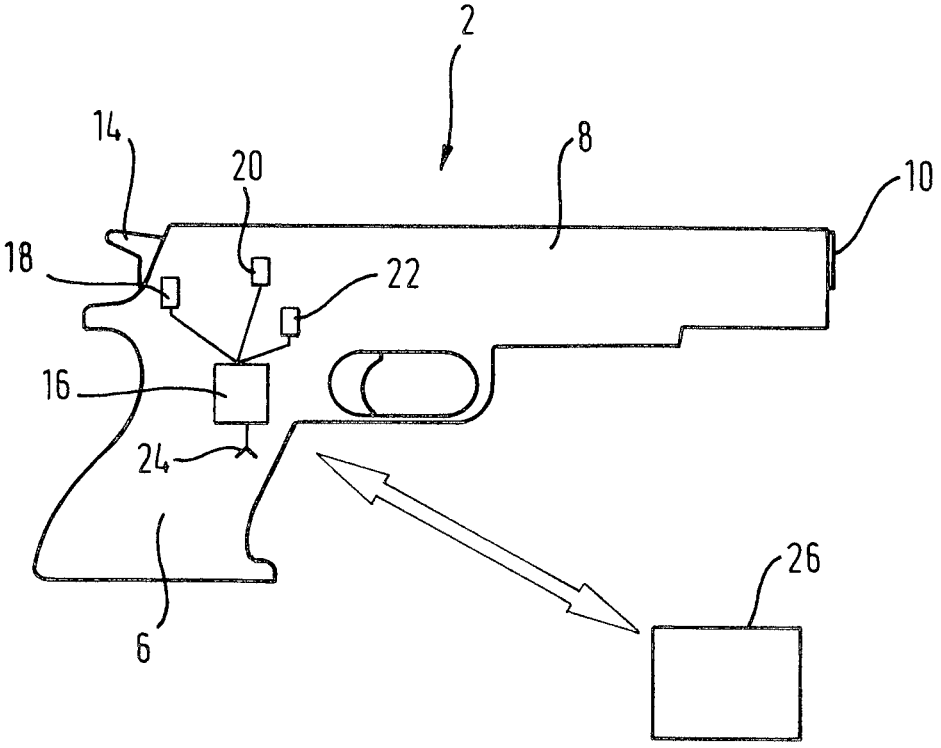
FIG. 2 shows a schematic representation of a firearm according to the invention.

FIG. 2 schematically illustrates a firearm 2 according to the invention comprising a controller 16. The controller 16 serves for controlling electrical and/or electronic components of the firearm 2 and, in particular, one or, as shown in FIG. 2, a plurality of so-called destruction units 18, 20 and 22. In particular, the designation destruction unit is supposed to indicate the function thereof, namely to preferably permanently disable, i.e. destroy, a function of the firearm. In particular, is intended to render the function of one or a plurality of mechanical and/or structural components of the firearm inoperative. This is explained in greater detail further below.

The controller 16 and the destruction units 18, 20 and 22 are communicatively connected to each other, for example wired, for transmitting data and/or signals at least from the controller 16 to the destruction units 18, 20 and 22. Transmission of information from the destruction units 18, 20 and 22 to the controller can also be provided for transmitting e.g. information on the operability of the destruction units 18, 20 and 22 to the controller 16.

The controller 16 comprises a receiving section 24 which is, as illustrated, integrated in the controller 16 and for which an antenna for receiving (in further embodiments also for transmitting) wireless information is representatively shown in FIG. 2. In further variants, the receiving section can be a unit implemented separately from the controller 16, arranged in the firearm 2 and communicatively connected to the controller 16. Information can be wirelessly transmitted to the controller 16 via the receiving section for externally controlling the firearm 2. In particular, it is provided according to the invention that information is provided to the controller 16, based on the presence and/or absence of which the controller 16 controls the destruction units 18, 20 and 22.

Thus, the controller 16 can activate, for example, one or a plurality of the destruction units 18, 20 and 22 when the controller 16 receives specific information and/or does not receive specific information. Examples of this are described in greater detail further below.

FIG. 2 shows three destruction units 18, 20 and 22, wherein no limitation to this number is intended. Any number, great or small, of destruction units can be accommodated in a firearm. Criteria for the number of destruction units comprise the space available in the firearm, to what extent the functions of a firearm are to be disabled and under what preconditions this is to take place.

In the embodiment of FIG. 2, destruction unit 18 is associated with the hammer 14, destruction unit 20 is associated with the firing pin of the firearm 2, and destruction unit 22 is associated with the lock of the firearm 2.

The firearm 2 is preferably a firearm controlled in such a manner that a shot can be fired only under certain conditions (e.g. in and/or outside of predetermined geographic areas (e.g. rooms, open-air sites etc.), and/or in predetermined directions (especially in directions in which firing a shot is permitted), and/or by authorized persons. The firearm 2 can be provided with information on whether a condition is present, whether firing of a shot is permitted and/or not permitted, and/or whether the firearm is handled by an authorized person by means of a separate device 26. In FIG. 2, a device 26 is shown which is capable of wirelessly transmitting information to the firearm 2. One example of such an enabling and/or disabling device 26 is, for example, a transmitter worn by an authorized person which is capable of transmitting authentication information to the firearm 2. The device 26 can also be a device arranged in an area in which the firearm 2 is permitted to be used, and/or in which the firearm 2 is not permitted to be used. When the firearm 2 is located in the corresponding area, the firearm 2 can be enabled for firing a shot or can be disabled for preventing the firing of a shot by means of such a device 26.

Irrespective of the control of the firearm 2 with respect to enablement and/or disablement thereof, it is intended for the destruction unit to be activated in and/or outside of predetermined areas, such as e.g. when the firearm leaves a predetermined area (e.g. a shooting stand/range etc.), and/or arrives at a predetermined area (e.g. school grounds, public authority, etc.). For this purpose, the position of the firearm can be determined, for example, by means of GPS positioning of the firearm.

In addition or alternatively, the destruction unit can be activated in a time-dependent manner. For example, it can be checked whether a predetermined period of time has elapsed and, if this is the case, the destruction unit can be activated. If one or a plurality of predetermined conditions is/are met within the predetermined period, the expiration of time can be stopped and re-started so that the predetermined period will again be fully available once the condition(s) is/are met. Such conditions comprise inputting a control command, code, etc. on the firearm itself (e.g. input by means of keys on the firearm, data transmission by means of a transponder), and/or on a separate, remote device which then transmits a corresponding control command, code, etc. to the firearm. When such an input takes place prior to expiration of the predetermined period, the (automatic) time-dependent destruction of the firearm within the currently expiring predetermined period is prevented. Subsequently thereto, the predetermined time frame starts again, in which the firearm is either reset with respect to expiration of time or, after expiry of which, the firearm is (automatically) destroyed in a time-dependent manner. In addition or alternatively, the temporal resetting can also take place in a position-dependent manner, e.g. by bringing the firearm (back) to a predetermined area, for example, a firearm locker.

The destruction unit can be purposefully destroyed at the desire of a person, for example, by inputting a control command, code, etc. on the firearm itself (e.g. input by means of keys on the firearm, data transmission by means of a transponder), and/or on a separate, remote device which then transmits a corresponding control command, code, etc. to the firearm.

The firearm can (in addition or alternatively) be disabled and/or enabled by means of voice control/voice recognition/voice activation in a radio-controlled manner (e.g. by means of specific transmitters and/or via a radio communication network, e.g. GSM, UMTS, LTE, WLAN), and/or by means of control signals which are transmitted, for example, via a communication network (e.g. Internet, Intranet, WLAN) to the firearm. In the latter case, the control signals can be transmitted wirelessly to the firearm, for what purpose the firearm comprises a corresponding receiving device, such as e.g. for WLAN, and/or in a wired manner, if the firearm is connected to a corresponding communication interface (e.g. in a firearm locker). Furthermore, the firearm can be disabled and/or enabled by means of image recognition. This can be implemented, for example, by means of an image capturing device which is integrally connected to or integrated in the firearm, or which is communicatively coupled to the firearm as an external component. By means of image recognition, for example, the face, hand or another part (or parts) of the body of a current user can be detected and verified whether this is an authorized user or not. The verification can be implemented e.g. by a comparison with a databank or database, in which image data of areas of the bodies of authorized users are stored.

It is further provided to render the firearm unusable by activating its destruction unit in an externally controlled manner. This can be implemented, for example, by voice control/voice recognition/voice activation in a radio-controlled manner (e.g. by means of specific transmitters and/or via a radio communication network, e.g. GSM, UMTS, LTE, WLAN), and/or by means of control signals which are transmitted, for example, via a communication network (e.g. Internet, Intranet, WLAN) to the firearm. In the latter case, the control signals can be transmitted wirelessly to the firearm, for what purpose the firearm comprises a corresponding receiving device, such as e.g. for WLAN, and/or in a wired manner, if the firearm is connected to a corresponding communication interface (e.g. in a firearm locker). Furthermore, the destruction unit can be activated by means of image recognition. This can be implemented, for example, by means of an image capturing device which is structurally connected to or integrated in the firearm, or which is communicatively coupled to the firearm as an external component. By means of image recognition, for example, the face, hand or another part (or parts) of the body of a current user can be detected and verified whether this is an authorized user or not. The verification can be implemented e.g. by a comparison with a databank or database, in which image data of areas of the bodies of authorized users are stored.

Embodiments of destruction units according to the invention are explained in greater detail with reference to FIGS. 3 to 10. Explanations on the various embodiments basically apply to all shown and described variants of destruction elements according to the invention, unless the contrary is stated.

Figure 3:
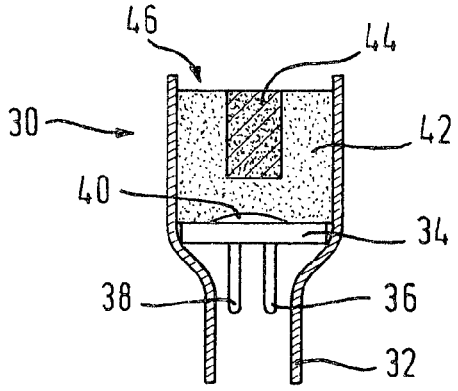
FIG. 3 shows a schematic representation of an embodiment of a destruction unit according to the invention.

FIG. 3 illustrates a destruction unit 30 having a housing 32 which can, for example, have the form of a sleeve made of zirconium oxide. An ignition element 34 is arranged in the housing 32 and also serves as a base or bottom for the further components here. The ignition element 34 can be provided in the form of a wire igniter which can be electrically activated by means of two terminals 36 and 38 and can be formed, for example, on a pressure and heat resistant glass-metal base.

An ignition composition 40 is arranged on the ignition element 34 and can comprise, for example, a CuO/Zr mixture. The ignition composition 40 can be applicable to the ignition element 34 in the form of a paste and/or can be plastic-bonded. The temperature, at which the ignition composition 40 is activated, can be e.g. approx. 480° C.

The space located above in the housing 32, according to the illustration, is substantially filled with a heating composition 42 into which a filling composition 44 is embedded in such a manner that it is exposed at the top housing opening 46.

The heating composition 42 can comprise e.g. a $Ti/MoO_3$ mixture. The heating composition 42 can be applicable e.g. in the form of a paste and/or be plastic-bonded as well.

The filling composition 44 can comprise, for example, an aluminum alloy capable of forming an aluminum foam due to heating, or an intermetallic reactive mixture on Ti basis, preferably having a high reaction temperature, which is capable of forming a metallic hard material due to heating.

The mode of operation of the destruction unit 30 is substantially as follows. By applying an electrical voltage to the terminals 36 and 38 of the ignition element 34, the ignition composition 40 is ignited which then generates heat and pressure and thus acts on the heating composition 42. The pressure acting from the ignition composition 40 on the heating composition 42 and thus also on the filling composition 44 discharges the heating composition 42 and the filling composition 44 from the housing 32 through a housing opening 46. Here, the housing opening 46 forms the outlet opening of the destruction unit 30. By supplying heat from the ignition composition 40, the heating composition 42 is ignited as well and generates heat, preferably for a longer period of time than the ignition composition 40 (e.g. 50-100 ms). The prolonged heat generation is necessary especially if the filling composition 44 requires a high initiating energy for conversion thereof.

When a filling composition 44 comprising an aluminum alloy is used, an aluminum foam is generated by supplying heat (e.g. more than 450° C.) for filling (at least in part) e.g. a space or cavity, as described further below.

When a filling composition 44 comprising an intermetallic reactive mixture on Ti basis is used, an exothermic reaction is caused by supplying heat, the reaction product of which is a metallic hard material. This metallic hard material can be used for filling (at least in part) e.g. a space or cavity, as described further below.

Figure 4:
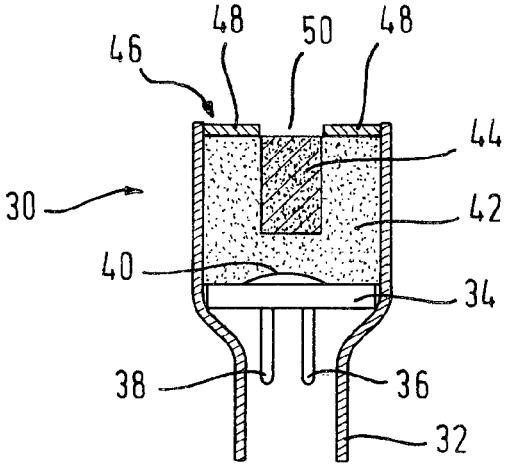
FIG. 4 shows a schematic representation of an embodiment of a destruction unit according to the invention.

The embodiment of a destruction unit 30 illustrated in FIG. 4 differs from the embodiment of FIG. 3 in that a cover 48 having a substantially central aperture 50 is arranged at the opening 46 of the housing 32.

The cover 48 can have the form of a covering layer applied to the surfaces (not designated) of the heating composition 42 exposed at the housing opening 46. Alternatively or in addition, the cover 48 can comprise a ring (e.g. including plastic material and/or metal).

In all cases, the aperture 50 of the cover 48 is preferably implemented in such a manner that the area of the filling composition 44 exposed at the housing opening 46 is not or only marginally covered. In such embodiments, the aperture 50 forms the outlet opening of a destruction unit.

The cover 48 provides a directed manner in which the heating composition 40 and especially the filling composition 44 are discharged from the housing 23 upon activation. In particular, heat dissipation from the heating composition 42 via the opening 46 is at least reduced by the cover 48 so that more heat of the heating composition 42 can be supplied to the filling composition 44. Furthermore, ejection of the filling composition 44 is directed in an improved manner by means of the aperture 50.

Figure 5:
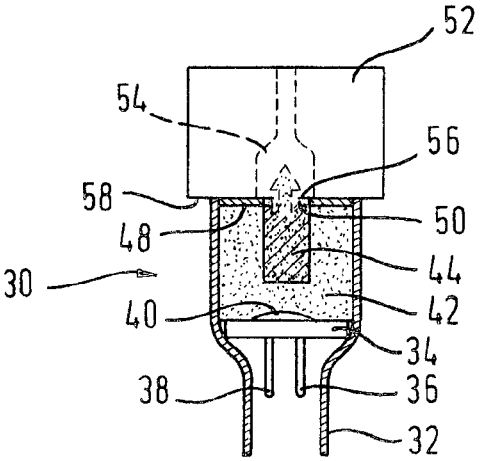
FIG. 5 shows a schematic representation of a use of the destruction unit of FIG. 4.

FIG. 5 illustrates the already above-mentioned possibility provided according to the invention of filling (at least in part) a space 54 or cavity provided by a body 52 by means of a destruction unit. FIG. 5 shows the embodiment of FIG. 4, instead of which any other embodiment according to the invention can be used. Upon activation of the ignition element 30, as explained above, the filling composition is discharged from the housing 32. For filling (at least in part) the space 54 with material and/or reaction products of the filling composition 44, the destruction element 30 is arranged such that the aperture 50 substantially coincides with an opening 56 of the space 54. Upon activation of the destruction unit 30, material and/or reaction products of the filling composition 44 is/are discharged through the aperture 50 of the cover 48 into the space 54 and fill(s), at least in part, the space. Preferably, the filling material solidifies.

Depending on the type of the filling composition 44 used, the space 54 is filled (at least in part) in such a manner that the filling material firmly connects to the wall of space 54 and can be removed therefrom only with difficulty, if at all.

On principle, the variant of FIG. 3 can be used as well. Then, the destruction unit 30 is arranged at the body 52 such that the area of the filling element 44 exposed at the opening 46 substantially coincides with the opening 56 of the space 54. Thus, the space 54 can also be filled (at least in part) with material and/or reaction products of the filling composition 44. When a destruction element 30 not having a cover 48 is used, improved filling of the space 54 is achieved if the destruction element 30 is firmly connected to the body 52 (e.g. by means of contact pressure), preferably such that, even upon activation of the destruction element 30, the destruction element and the body 52 are connected to each other and do substantially not move relative to each other. Thus, material and/or reaction products discharged from the housing 32 is/are prevented from not entering the space 54 and attaching, for example, to the bottom side 58 of the body 52.

Figure 6:
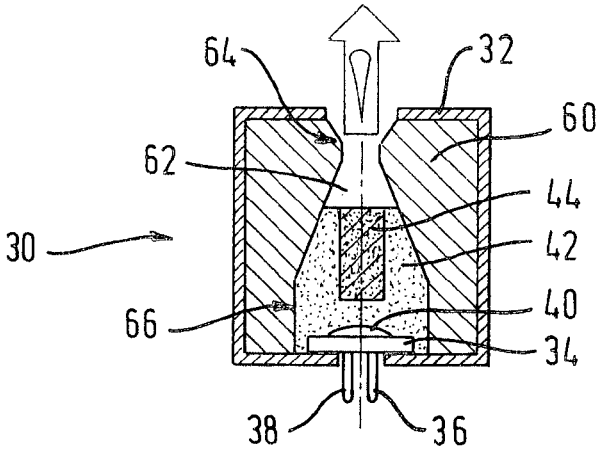
FIG. 6 shows a schematic representation of an embodiment of a destruction unit according to the invention.

In the variant of FIG. 6, an insert 60 is arranged in the housing 32. The insert 60 comprises a space 62 which provides defined internal structures for receiving especially the heating composition and the filling composition, on the one hand, and for a preferably targeted discharge of material and/or reaction products from the housing 32, on the other hand, when the destruction element 30 is activated.

The insert 60 comprises a mouth area 64 and an area 66 provided for receiving the components 34 to 44.

Figure 7:
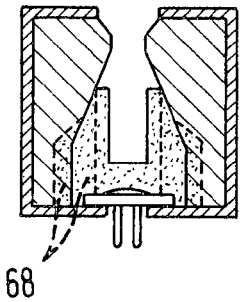
FIGS. 7 and 8 show schematic representations of variants of the embodiment of FIG. 6.
Figure 8:
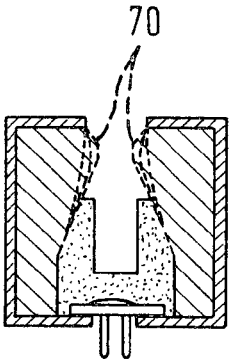

As illustrated in FIGS. 7 and 8, the mouth area 64 and/or the receiving area 66 can be varied (e.g. depending on the respective application) for varying the discharge behavior of material and/or reaction products from the housing 32 and the amounts of the heating composition and/or filling composition, respectively. For example, by enlarging or reducing 68 a receiving area 66, stronger or weaker reactions, greater or smaller filling amounts, etc. can be achieved. By a variation 70 of the mouth area 64, different "nozzle" geometries can be achieved, by means of which, for example, the discharge speed of material and/or reaction products can be influenced.

The insert 70 preferably comprises a material which is thermally stable under oxygen exclusion, for example, graphite.

Figure 9:
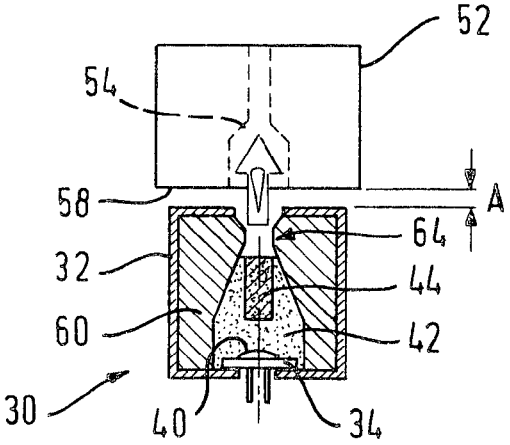
FIG. 9 shows a schematic representation of a use of the destruction unit of FIG. 6.

FIG. 9, as FIG. 5, serves the purpose of illustrating how a space 54 can be filled at least in part. FIG. 9 shows an application in which there is a spacing A or intermediate space between the filling element 30 and the body 52 (e.g. for design reasons). In such cases, for filling, at least in part, the space 54 with material and/or reaction products from the destruction element 30, the use of an insert 60 can be advantageous.

Figure 10:
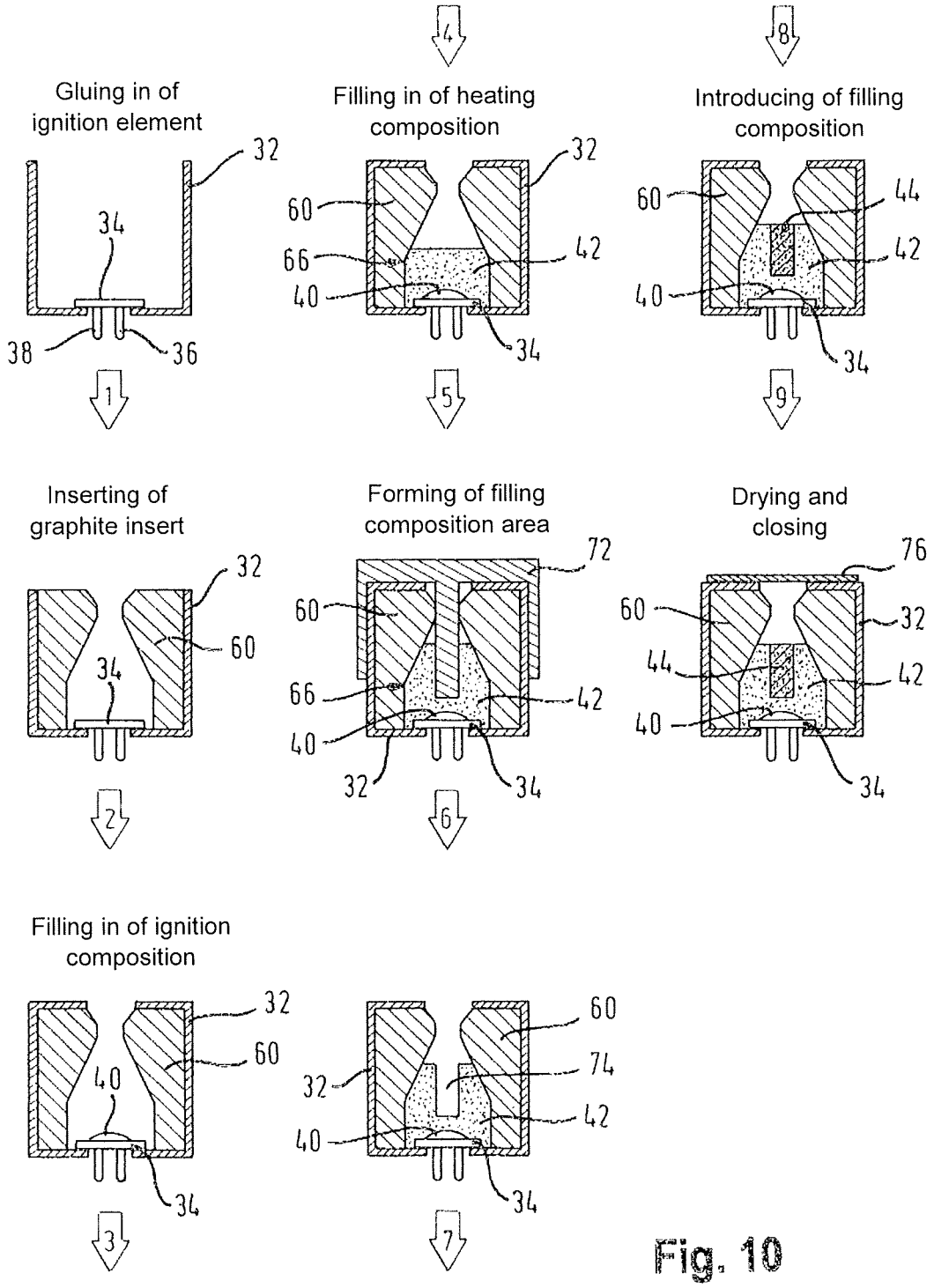
FIG. 10 shows a schematic representation of manufacturing a destruction unit according to the invention.

FIG. 10 schematically shows the manufacturing of a destruction unit 30 according to the embodiment of FIG. 6. Initially, an ignition element 34 is arranged in the housing 32, for example, by gluing. Then, an insert 60 is inserted and the ignition composition 40 is arranged on the ignition element 34. In variants, the ignition element 34 is preferably previously provided with the ignition composition 40 and jointly arranged in the housing 32. Furthermore, it is possible, after arrangement of the ignition element 34, to initially arrange the ignition composition 40 thereon and to then insert them jointly into the housing 32.

In a next step, a heating composition 42 is arranged in the receiving area 66 of the insert 60. By means of a tool 72, a receptacle 74 is formed in the heating composition 42, in which a filling composition 44 is arranged in a next step.

Depending on the type of the materials used, especially for the heating composition 42 and/or the filling composition 44, the entire arrangement can then be dried. The destruction unit 30 can be closed by means of a cover or closure 76 in order to protect it after manufacture up to its use/installation.

Referring to FIGS. 11 and 12, basic modes of operation of a destruction unit according to the invention are explained. FIGS. 11*a* and 11*b* illustrate a destruction unit ZE, by means of which a positive-locking disablement is achieved. FIGS.

12*a* and 12*b* illustrate a destruction unit ZE, by means of which a substantially frictional-locking disablement is achieved.

FIGS. 11 and 12 functionally illustrate embodiments, in which a moveable component BK, which is moveable in directions B within a component ST stationary relative thereto, is disabled, i.e. can no longer be moved in direction B, by filling, at least in part, a movement space BR with filling material FM.

FIG. 11*a* illustrates an arrangement including a moveable component BK which is moveable in directions B within a component ST stationary relative thereto. For moving the moveable component BK within the stationary component, a movement space BR is provided, into and out of which the moveable component can be moved. This is illustrated in FIG. 11*a* by the dashed line.

The arrangement of FIG. 11*a* comprises a destruction unit ZE, embodiments of which are described above with reference to FIGS. 3 to 10. Only a filling composition FS of the destruction unit ZE is indicated in FIG. 11*a* in a simplified manner. The destruction unit ZE comprises an outlet opening A which is in fluid communication with an inlet opening E of the movement space BR and is thus in fluid communication therewith. The outlet opening A and the inlet opening E form a material passage.

In the state shown in FIG. 11*a*, the arrangement is operable, i.e. the moveable component BK is moveable.

In order to render the arrangement inoperable/unusable, the destruction unit ZE is activated, in particular, by igniting its destruction element. Activation causes, as described above, the filling composition to be discharged from the destruction unit ZE through its outlet opening A and the inlet opening E into the movement space BR. In this process, the filling composition is converted, as described above, into filling material FM, at least in the movement space BR. The filling material FM fills, at least in part, the movement space BR in such a manner that movements of the moveable component in direction B are no longer possible.

For this purpose, it is not necessary, as illustrated in FIG. 11*b* in a simplified manner, to completely fill the movement space. Inoperability of the arrangement of FIG. 11 is achieved when the movement space BR is filled with filling material FM to such an extent and/or in such places that the moveable component BK cannot be moved into the movement space BR. Movements of the moveable component BK in the opposite direction are prevented when the filling material FM connects, at least in part, to the front face FS of the moveable component BK.

The state shown in FIG. 11*b* shows the arrangement in an inoperable/unusable state.

Embodiments, in which the principle illustrated in FIG. 11 is used, are also referred to as positive-locking embodiments.

FIG. 12*a* illustrates an arrangement including a moveable component BK which is moveable in directions B within a component ST stationary relative thereto. The moveable component BK in FIG. 12*a* comprises a recess N. The movement space BR of the arrangement of FIG. 12 comprises a movement space BRa comparable to the movement space BR of FIG. 11. Furthermore, there is a movement space BRb, both movement spaces BRa and BRb being necessary for the arrangement to be operable, i.e. for the moveable component BK to be moveable. Also in this case, a destruction unit ZE, shown in a simplified manner with a filling composition FS, is present which is in fluid communication, via an outlet opening A, with an inlet opening E to the movement space BRb and is thus in fluid communication therewith.

FIG. 12*a* shows the arrangement in the operable state.

In order to render the arrangement inoperable/unusable, i.e. to prevent movements of the moveable component BK, the destruction unit ZE is activated. This results in an at least partial filling of the movement space BRb with filling material FM. Due to the filling material FM present in the movement space BRb, the movement space BRb is no longer, or no longer fully, available so that the moveable component can no longer be moved.

In such arrangements, there are, as compared to FIG. 11, smaller interfaces between filling material FM and the moveable component BK. Such arrangements can be compared to the effect of a brake pad of a bicycle brake acting on a wheel rim during braking. Thus, such arrangements can also be referred to as frictional-locking arrangements.

A combination of positive-locking and frictional-locking embodiments can be achieved when the arrangements of FIGS. 11 and 12 are combined by providing two destruction units ZE which fill, at least in part, the movement spaces BRa and BRb.

Figure 13:
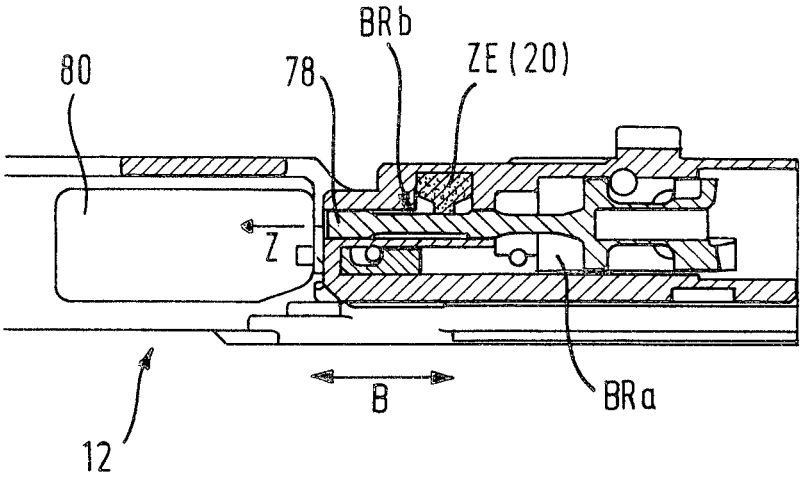
FIG. 13 shows a schematic representation of an embodiment of the present invention for disabling the firing pin of a firearm.

FIG. 13 schematically illustrates an embodiment for disabling a firing pin of a firearm. FIG. 13 schematically shows a partial cross-sectional top view of the firearm 2 through part 12 which comprises the lock 82 and a firing pin 78. The firing pin 78 is moveable in directions B. In order to ignite a cartridge arranged in a cartridge chamber 80, the firing pin 78 is moved to the left according to FIG. 13. This is illustrated by arrow Z. Then, the firing pin 78 is moved back in the opposite direction. When the firing pin 78 is moveable, it and thus the firearm 2 is operable and functional if the further components thereof are also properly operating and have not been rendered inoperable/unusable, as e.g. described in the following.

For moving the firing pin 78, a movement space BRb is provided which is, in principle, comparable to the movement space BRb of FIG. 12. The firearm 2 comprises a destruction unit ZE which is designated by 20 in the above FIG. 2. To disable the firing pin 78, i.e. to permanently prevent movement thereof, the destruction unit ZE (20) is activated and filling material is thus introduced into the movement space BRb. As explained with reference to FIG. 12, movements of the firing pin 78 are prevented thereby.

FIG. 13 shows a further movement space BRa which is comparable to the movement spaces BR of FIG. 11 and BRa of FIG. 12, respectively. By means of a further destruction unit, as explained above with reference to FIG. 11, the movement space BRa can, in addition or alternatively, be filled, at least in part, with filling material to prevent movements of the firing pin 78.

Figure 14:
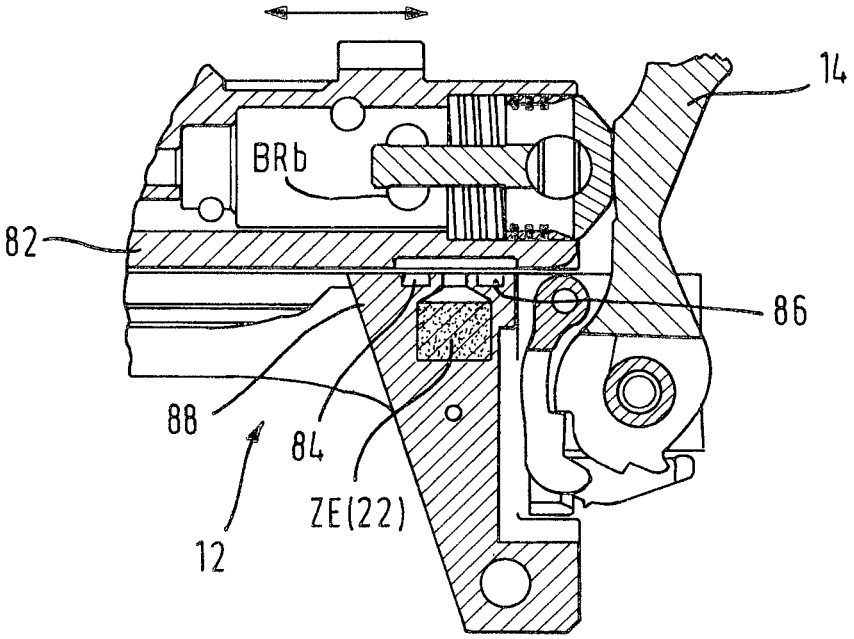
FIG. 14 shows a schematic representation of an embodiment of the present invention for disabling the lock of a firearm.

FIG. 14 illustrates a variant for disabling a lock 82 of the firearm 2. FIG. 14 schematically shows a cross-sectional view in the area of part 12 of the firearm 2. There, the lock 82 is arranged to be moveable in directions B. By means of a destruction unit ZE, which is designated by 22 in the above FIG. 2, a movement space BRb can be filled (at least in part) with filling material, as explained above. Thus, the lock 82 is prevented from moving. Furthermore, the embodiment shown in FIG. 14 shows two spaces 84 and 86. Instead of the shown spaces 84 and 86, an annularly extending space can be used. Upon activation of the destruction unit ZE (22), filling material is introduced also into spaces 84 and 86 (or the annular space). By means of the filling material in the movement space BRb and in spaces 84 and 86, a preferably firm, non-releasable connection of the lock 82 to a part 88 of the handle piece, in which the spaces 84 and 86 are arranged, is additionally achieved. This connection constitutes an additional safeguard which prevents removal of the lock 82.

Figure 15:
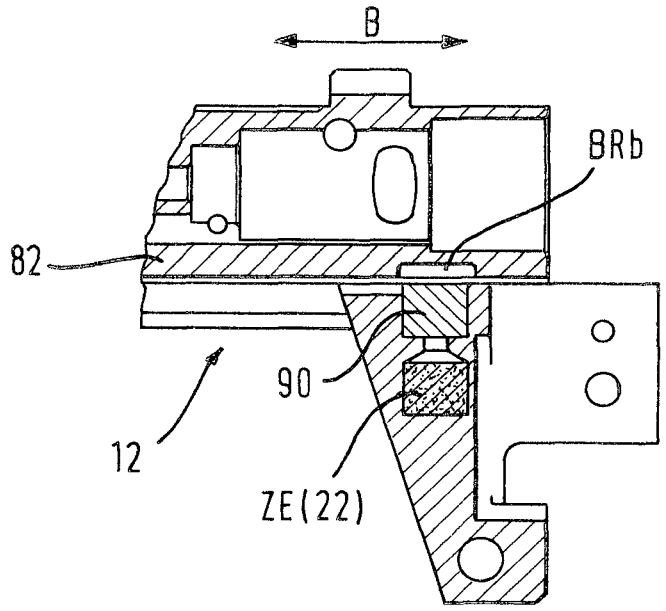
FIG. 15 shows a schematic representation of a further embodiment of the present invention for disabling the lock of a firearm.

FIG. 15 shows a further variant for rendering the lock of a firearm inoperable/unusable. Except for the following explanations, the explanations made with respect to FIG. 14 also apply to FIG. 15. In the embodiment of FIG. 15, a moveable latching means 90 is arranged between the movement space BRb and the destruction unit ZE (22). Upon activation of the destruction unit ZE (22), the latching means 90 is moved into the movement space BRb by the discharged filling composition and the generated filling material, respectively. It is intended that filling material also enters the movement space BRb. The latching means 90 is fixed in the movement space BRb by means of the filling material. Movements of the lock 82 are then no longer possible. Furthermore, it is intended that filling material is present between the latching means 90 moved into the movement space BRb and the destruction unit ZE (22) in order to provide a back filling for the latching means 90 and to thus additionally fix the same.

Figure 16:
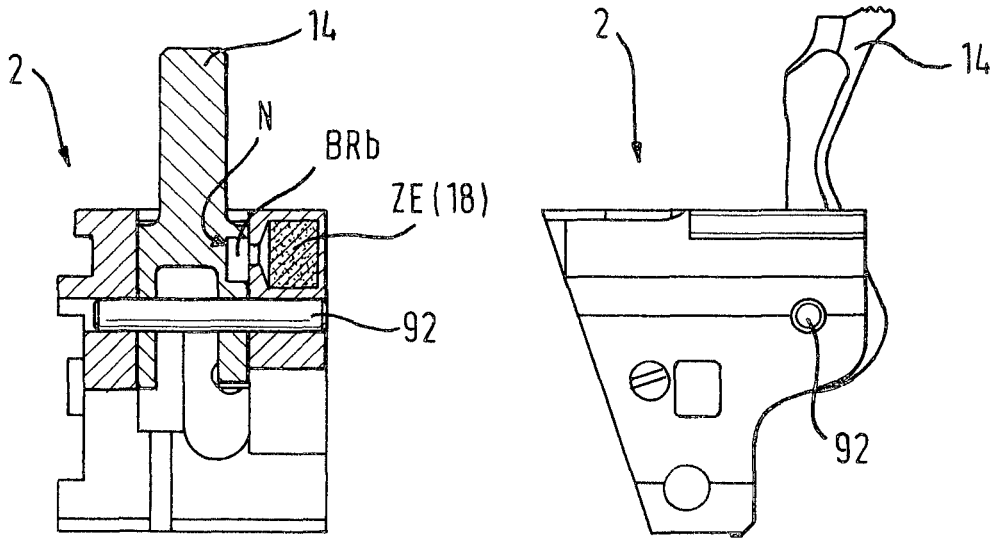
FIG. 16 shows schematic representations of an embodiment of the present invention for disabling the hammer of a firearm.

FIG. 16 illustrates an embodiment for rendering a hammer of a firearm inoperable/unusable. FIG. 16 shows schematic cross-sectional views of the part of the firearm 2 in which the hammer 14 is arranged. The hammer 14 is rotatably mounted by means of a shaft 92 in the handle piece. The hammer 14 comprises a recess N defining a movement space BRb. A destruction unit ZE, which is designated by 18 in FIG. 2, is arranged adjacent to the movement space BRb in the handle piece. Upon activation of the destruction unit ZE (18), the movement space BRb is filled, at least in part, with filling material so that the hammer 14 can no longer be pivoted and is consequently rendered inoperable/unusable.

Figure 17:
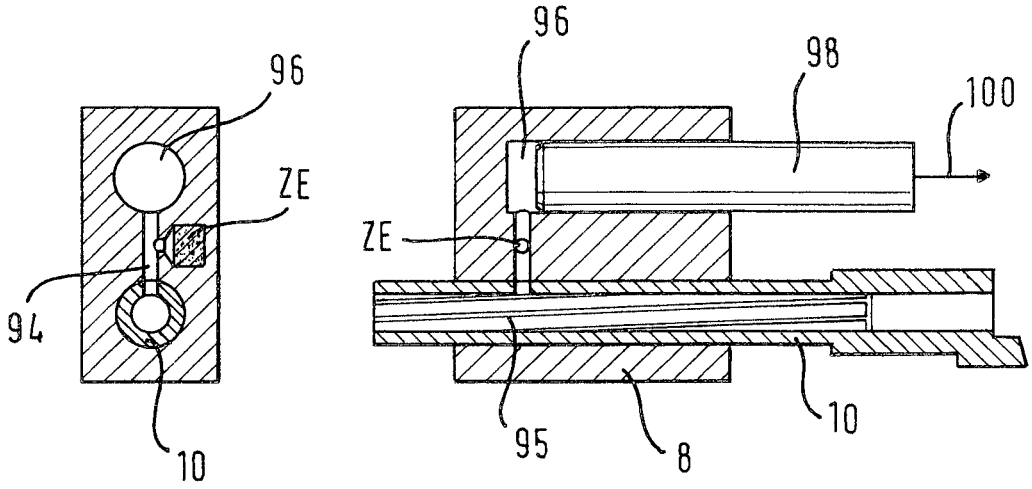
FIG. 17 shows schematic representations of an embodiment of the present invention for disabling the gas bore of a firearm.

FIG. 17 illustrates an embodiment in which a movement space of the firearm 2, which is provided for a fluid, is filled, at least in part, with filling material. FIG. 17 assumes a firearm which is implemented as a so-called gas-operated firearm, i.e. a firearm in which gas pressure, which is generated in the barrel when a shot is fired, is utilized for the next loading process for reloading a new cartridge. FIG. 17 shows, in sections, the area of such a firearm in the area in which a gas bore 94 is arranged. The gas bore 94 provides a channel-like fluid communication between the interior space 95 of the barrel 10 and a space 96 which is, for example, hollow cylindrical in shape. When a shot is fired, pressure generated in the barrel 10 is conducted into space 96 via the gas bore 94, where an actuating element 98 (e.g. a plunger) is moved in the direction of arrow 100 by means of this gas pressure. This movement of the actuating element 98, usually in combination with further downstream components, is used for reloading the firearm. After reloading, the actuating element 98 is moved back in the opposite direction, for example, due to spring pre-load.

A destruction unit ZE is arranged adjacent to the gas bore 94 which, upon actuation, introduces filling material into the gas bore 94 in such a manner that there is no longer a fluid communication between the barrel interior 95 and the space 96. This closure entails that the firearm is then no longer usable in that its function of automatic reloading is no longer available.

Figure 18:
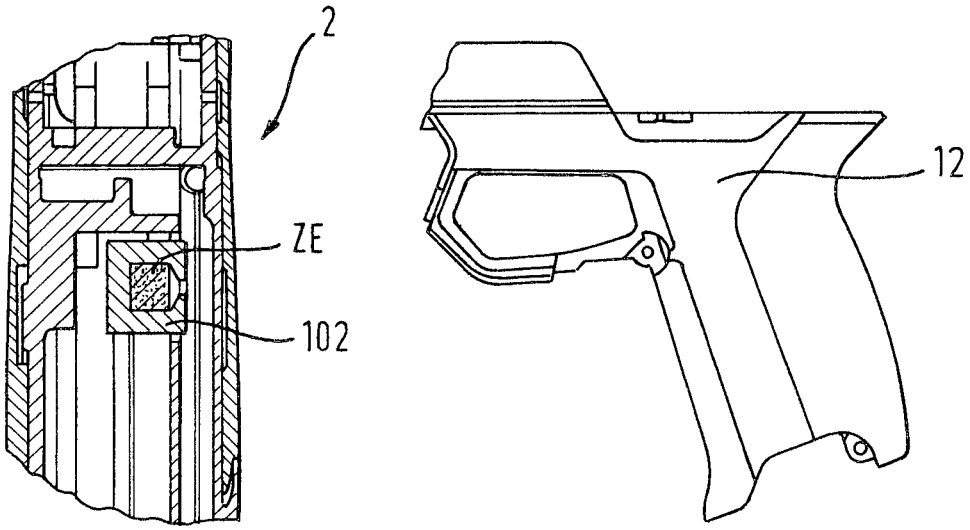
FIG. 18 shows schematic representations of an embodiment of the present invention for disabling an electrical and/or electronic component of a firearm.

FIG. 18 illustrates an embodiment in which a printed circuit board 102 of the firearm can be destroyed by means of a destruction unit ZE. In this embodiment, contrary to the above described variants, the printed circuit board 102 is damaged or destroyed in a substantially thermal manner.

LIST OF REFERENCE NUMERALS

| List of reference numerals | |
|---|---|
| 2 | firearm |
| 4 | housing |
| 6 | handle piece |
| 8 | part 8 with barrel 10 |
| 10 | barrel |
| 12 | part with lock |
| 14 | hammer |
| 16 | controller |
| 18 | destruction unit |
| 20 | destruction unit |
| 22 | destruction unit |
| 24 | receiving section |
| 26 | enabling and/or disabling device |
| 28 | ./. |
| 30 | destruction unit |
| 32 | housing |
| 34 | ignition element |
| 36 | terminal of ignition element |
| 38 | terminal of ignition element |
| 40 | ignition composition |
| 42 | heating composition |
| 44 | filling composition |
| 46 | housing outlet opening |
| 48 | cover of housing opening |
| 50 | aperture of cover |
| 52 | body with space or cavity |
| 54 | space or cavity |
| 56 | opening of space or cavity |
| 58 | bottom side of body |
| 60 | insert |
| 62 | space of insert |
| 64 | mouth area of insert |
| 66 | receiving area of insert |
| 68 | variation of receiving area |
| 70 | variation of mouth area |
| 72 | tool for forming a receptacle for a filling composition |
| 74 | receptacle for filling composition |
| 76 | closure/cover |
| BK | moveable component |
| ST | stationary component |
| B | directions of movement |
| BR | movement space |
| ZE | destruction unit |
| FS | filling composition |
| A | outlet opening of destruction unit |
| E | inlet opening to movement space |
| FM | filling material |
| FS | front face of moveable component |
| N | recess in moveable component |
| BRa, BRb | movement spaces |
| 78 | firing pin |
| 80 | cartridge chamber |
| Z | direction of movement of firing pin for igniting a cartridge |
| 82 | lock |
| 84, 86 | further spaces for filling with filling material |
| 88 | part of handle piece with spaces 84 and 86 |
| 90 | latching means |
| 92 | turning shaft of hammer |
| 94 | gas bore |
| 95 | interior space of barrel |
| 96 | space for receiving gas pressure |
| 98 | actuating element (plunger) |
| 100 | direction of movement of actuating element (plunger) |
| 102 | printed circuit board |

The invention claimed is:

1. A firearm, comprising:

a housing, a movement space, arranged in the housing, for a moveable component of the firearm or for a fluid moveable within the firearm, and a destruction unit arranged in the housing, and a material passage between the movement space and the destruction unit associated therewith, a filling composition which, upon activation thereof, is converted into filling material, and wherein the destruction unit can be activated for introducing a filling material into the movement space via the material passage and thus filling, at least in part, the movement space;

wherein the destruction unit comprises an ignition composition which, upon activation of the destruction unit, generates thermal energy for activating a heating composition and also generates pressure; and wherein the filling composition comprises a substance which, in response to activation of the destruction unit, reacts exothermically and/or solidifies, and introduces the filling material, at least in part, into the movement space.

2. The firearm according to claim 1, wherein the destruction unit comprises the filling composition including a substance which, upon activation of the destruction unit, is converted into filling material.

3. The firearm according to claim 1, wherein the heating composition including a substance which generates thermal energy for converting the filling composition into filling material, and which preferably also generates pressure for introducing filling material into the movement space.

4. The firearm according to claim 1, wherein the filling composition comprises a substance which, in response to activation of the destruction unit, expands, at least in part, in the movement space.

5. The firearm according to claim 1, wherein the movement space comprises a fluid passage being in fluid communication with a barrel of the firearm, and the material passage extends between the fluid passage and the destruction unit.

6. The firearm according to claim 1, wherein the movement space comprises:

an area extending substantially in a direction parallel to a direction of movement of the moveable component, and/or an area extending substantially in a direction perpendicular to the direction of movement of the moveable component.

7. The firearm according to claim 1, wherein the moveable component of the firearm comprises:

a firing pin of the firearm, and/or a hammer of the firearm, and/or a lock of the firearm.

8. The firearm according to claim 1, wherein the movement space extends, at least in part, into the moveable component.

9. The firearm according to claim 1, wherein the firearm comprises at least one electrical and/or electronic component and a destruction charge associated therewith.

10. The firearm according to claim 1, wherein the filling composition comprises:

an aluminum-metal foam alloy, and/or an intermetallic reactive mixture on Ti basis.

11. The firearm according to claim 1, wherein the ignition composition of the destruction unit is an electrically or electronically activatable ignition composition, which preferably comprises a wire igniter which is preferably arranged on a pressure and/or heat resistant base which preferably comprises glass and/or metal.

12. The firearm according to any one of preceding claim 1, wherein the ignition composition comprises a CuO/Zr mixture.

13. The firearm according to claim 3, wherein the heating composition comprises a $TiMoO_3$ mixture.

14. The firearm according to claim 3, wherein the heating composition is arranged in the destruction unit in such a manner that it surrounds, at least in part, the filling composition.

15. The firearm according to claim 1, wherein the destruction unit comprises a cover.

16. The firearm according to claim 1, wherein the cover comprises an outlet opening in the area of the filling composition arranged within the destruction unit.

17. The firearm according to claim 1, wherein the destruction unit comprises an insert, in which the filling composition is arranged.

18. The firearm according to claim 1, wherein the insert comprises a mouth area which is preferably formed as a nozzle.

19. A firearm destruction unit comprising:

a housing having an outlet opening, a filling composition which, upon activation thereof, is converted into filling material, and an ignition composition which, upon activation thereof generates thermal energy for activating a heating composition, and also generates pressure; and wherein the filling composition comprises a substance which, in response to activation of the destruction unit, reacts exothermically and/or solidifies, and introduces the filling material, at least in part, into a movement space of the firearm via the outlet opening.

20. The destruction unit according to claim 19, wherein the heating composition including a substance which generates thermal energy for converting the filling composition into filling material.

21. The destruction unit according to claim 19, wherein the filling composition comprises a substance which, in response to activation of the destruction unit, expands, at least in part, in the movement space.

22. The destruction unit according to claim 19, wherein filling composition comprises:

an aluminum-metal foam alloy, and/or an intermetallic reactive mixture on Ti basis.

23. The destruction unit according to claim 19, wherein the ignition composition is an electrically or electronically activatable ignition composition, which preferably comprises a wire igniter which is preferably arranged on a pressure and/or heat resistant base which preferably comprises glass and/or metal.

24. The destruction unit according to claim 19, wherein the ignition composition comprises a CuO/Zr mixture.

25. The destruction unit according to claim 20, wherein the heating composition comprises a $TiMoO_3$ mixture.

26. The destruction unit according to claim 20, wherein the heating composition is arranged in the destruction unit in such a manner that it surrounds, at least in part, the filling composition.

27. The destruction unit according to claim 19, wherein the destruction unit comprises a cover.

28. The destruction unit according to claim 19, wherein the cover comprises the outlet opening in the area of the filling composition arranged within the destruction unit.

29. The destruction unit according to claim 19, wherein the destruction unit comprises an insert, in which the filling composition is arranged.

30. The destruction unit according to claim 29, wherein the insert comprises a mouth area which is preferably formed as a nozzle.

31. A firearm comprising a destruction unit according to claim 19.

32. A method of disabling a firearm comprising a movement space which is arrange din a housing of the firearm and is provided for a moveable component of the firearm or for a fluid moveable within the firearm, wherein the method comprises:

providing a destruction unit, providing a material passage between the movement space and destruction unit, detecting a condition in which the firearm is to be disabled, and, when such a condition is detected, activating the destruction unit and converting a filling composition into a filling material by an ignition composition generating thermal energy which activates a heating composition and a filling composition substance responding to activation of the destruction unit and reacting exothermically and/or solidifying, and filling, at least in part, the movement space with a filling material.

33. The method according to patent claim 32, wherein filling material solidifies, at least in part, in the movement space.

34. The method according to patent claim 32, wherein the filling material is generated exothermically.

35. The method according claim 32, wherein the movement space for:

a firing pin, and/or a hammer, and/or a lock of a firearm is filled, at least in part, with a filling material.

36. The method according to claim 32, wherein the filling material is introduced into a gas bore being in fluid communication with the barrel.

* * * * *